US006749236B2

(12) United States Patent
Nomura et al.

(10) Patent No.: US 6,749,236 B2
(45) Date of Patent: Jun. 15, 2004

(54) DOOR HANDLE DEVICE FOR A VEHICLE

(75) Inventors: Morihito Nomura, Toyoake (JP); Kouichi Nagata, Ohbu (JP); Katsuaki Maruyama, Toyota (JP); Hajime Emura, Aichi-ken (JP)

(73) Assignee: Aisin Seikikkabushiki Kaisha, Kariya (JP)

( * ) Notice: Subject to any disclaimer, the term of this patent is extended or adjusted under 35 U.S.C. 154(b) by 0 days.

(21) Appl. No.: 09/855,701

(22) Filed: May 16, 2001

(65) Prior Publication Data

US 2002/0008389 A1 Jan. 24, 2002

(30) Foreign Application Priority Data

May 16, 2000 (JP) ..... 2000-143094

(51) Int. Cl.[7] ..... E05B 3/00

(52) U.S. Cl. ..... 292/336.3; 292/347; 292/348; 292/352; 292/DIG. 53; 16/412

(58) Field of Search ..... 292/336.3, 347, 292/348, 349, 352, DIG. 31, DIG. 53; 16/412, 266; 403/52, 353, 355

(56) References Cited

U.S. PATENT DOCUMENTS 2,460,216 A * 1/1949 Dalton ..... 403/152
4,475,754 A * 10/1984 Arlauskas et al. ..... 292/336.3
4,580,822 A * 4/1986 Fukumoto ..... 16/266
4,858,973 A * 8/1989 Ogasawara et al. ..... 292/347
5,005,885 A * 4/1991 Kobayashi et al. ..... 292/336.3
5,651,163 A * 7/1997 Tamaki ..... 16/412
5,685,581 A * 11/1997 Kritzler et al. ..... 292/336.3
5,791,703 A * 8/1998 Kritzler et al. ..... 292/336.3
5,794,994 A * 8/1998 Miyagawa et al. ..... 292/336.3
5,887,918 A * 3/1999 Okada et al. ..... 292/141
6,059,329 A * 5/2000 Spitzley ..... 16/412
6,167,779 B1 * 1/2001 Sano et al. ..... 292/336.3
6,234,548 B1 * 5/2001 Mittelbach et al. ..... 292/336.3
6,363,577 B1 * 4/2002 Spitzley ..... 16/412
6,401,302 B1 * 6/2002 Josserand et al. ..... 16/444

FOREIGN PATENT DOCUMENTS

JP 8-35360 A 2/1996

* cited by examiner

*Primary Examiner*—Robert J. Sandy
*Assistant Examiner*—Thomas Ho
(74) *Attorney, Agent, or Firm*—Burns, Doane, Swecker & Mathis, L.L.P.

(57) ABSTRACT

A vehicle door handle device includes a frame secured to the inside of the outer panel of a vehicle door and having a supporting portion and insertion holes, a link rotatably mounted on the frame and urged by an elastic member in one direction, and an outer handle mounted from outside the outer panel. The outer handle is adapted to operate the link to rotate the link against the rotational urging force of the elastic member. The link possesses a first engaging portion and axle portions having two faced portions. The frame is provided with slots for inserting the two faced portions and supporting holes for rotatably supporting the axle portions. The frame also includes a second engaging portion which engages the first engaging portion for holding the link in a preliminary holding position.

20 Claims, 6 Drawing Sheets

DOOR HANDLE DEVICE FOR A VEHICLE

This application is based on and claims priority under 35 U.S.C. §119 with respect to Japanese Patent application No. 2000-143094 filed on May 16, 2000, the entire content of which is incorporated herein by reference.

FIELD OF THE INVENTION

The present invention generally relates to a vehicle door handle. More particularly, the present invention pertains to a vehicle door handle device having a grip-type outer door handle.

BACKGROUND OF THE INVENTION

An example of a known door handle device for a vehicle is disclosed in Japanese Patent Laid-Open Publication No. Hei.8(1996)-35360. This door handle device includes a frame secured to the inside of an outer panel of a vehicle door. The frame has a supporting portion and insertion holes. A link is mounted to the frame so as to be able to rotate and is urged in one rotational direction by a spring. A grip-type outer handle is mounted from outside the outer panel and is able to operate the link to rotate against the rotational urging force of the spring. The outer handle is provided at its one end with an engaging portion which is inserted through an insertion hole formed on the outer panel and which is engaged with the supporting portion so as to be able to swing. The outer handle is provided at its the other end with an insertion projection which is inserted through the insertion holes formed on the outer panel and the frame and which has an engaging concave portion engaged with an input portion of the link.

In the above door handle device, the link is mounted to the supporting portion of the frame by a supporting shaft so as to be able to rotate and so as to be able to move axially on the supporting shaft. A guide lever which is rotatably mounted on the supporting shaft and which is urged by the spring in one direction engages the link so as to be able to rotate together and engages a stopper projection formed on the frame. The link is urged in the axial direction by a second spring mounted on the supporting shaft and contacts a stopper surface of the guide lever so that the link is held in its preliminary holding position. Under the condition in which the link is held in a preliminary holding position, the link can move in the axial direction against the urging force of the second spring. Therefore, by using this movement of the link, the outer handle can be mounted from the outside the outer panel.

However, the above-described door handle device requires many parts such as the supporting shaft, the spring, the guide lever and the second spring for holding the link in the preliminary holding position. Therefore, the operation efficiency associated with mounting the link on the frame is diminished and the manufacturing costs associated with the door handle device increase.

Thus, a need exists for a vehicle door handle device that is not as susceptible to the same disadvantages and drawbacks as those discussed above.

SUMMARY OF THE INVENTION

A vehicle door handle device includes a frame secured to the inside of an outer panel of a vehicle door and having a supporting portion and insertion holes. A link is mounted to the frame for rotation and is urged by an elastic member to rotate in one direction. A grip-type outer handle is mounted from outside the outer panel and is able to operate the link to rotate against the rotational urging force of the elastic member. The link is provided with a first engaging portion and axle portions. The frame is provided with slots for inserting the two faced portions, supporting holes for rotatably supporting the axle portions and a second engaging portion which engages the first engaging portion for holding the link in a preliminary holding position.

According to another aspect of the invention, a vehicle door handle device includes a frame secured inside an outer panel of a vehicle door and a link rotatably mounted on the frame. The frame has insertion holes, a pair of slots, a pair of supporting holes, and an engaging portion. The link has an engaging portion and a pair of axle portions each having at least one flat surface. Each axle portion is insertable into one of the slots in the link and is rotatably supported by one of the supporting holes. A spring is connected to the link and applies a rotational urging force to the link in one rotational direction. An outer handle has an insertion portion passing through the outer panel and into one of the insertion holes, and an engaging portion passing through the outer panel and into another of the insertion holes. The insertion portion of the outer handle is in engagement with a portion of the link to rotate the link against the urging force of the elastic member upon operation of the outer handle. The engaging portion of the frame engages the engaging portion of the link to hold the link in a preliminary holding position.

In accordance with another aspect of the invention, a vehicle door handle device includes a frame secured inside an outer panel of a vehicle door, and having a first pair of supporting holes and a second pair of supporting holes. A link is rotatably mounted on the frame by way of a pair of first axle portions and a pair of second axle portions. The first axle portions and the second axle portions having different cross-sectional shapes, with each of the first axle portions being rotatably supported in one of the first supporting holes and each of the second axle portions being rotatably supported in one of the second supporting holes. A spring is connected to the link and applies a rotational urging force to the link in one rotational direction. An outer handle is mounted from outside the outer panel of the vehicle, and a portion of the outer handle engages a portion of the link to rotate the link against the urging force of the elastic member upon operation of the outer handle. In addition, a portion of the frame engages a portion of the link to hold the link in a preliminary holding position.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
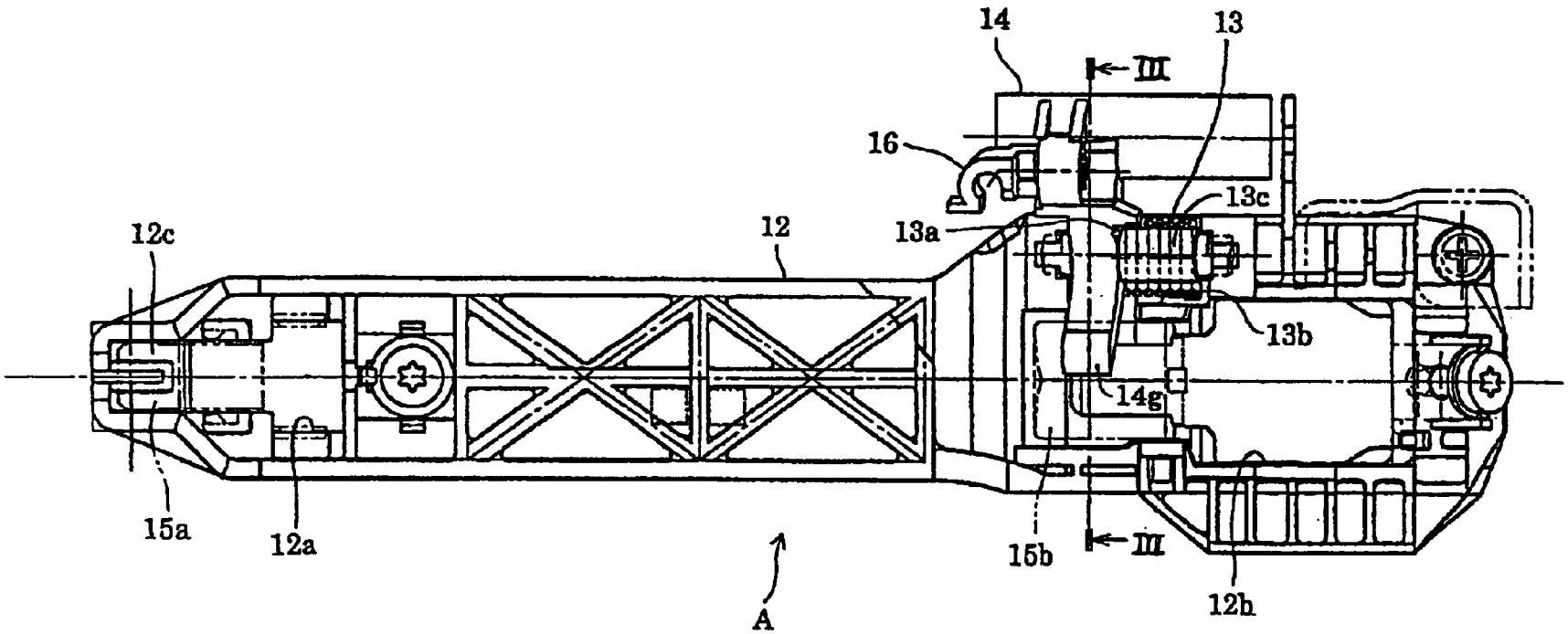
FIG. 1 is a side view of a door handle device for a vehicle in accordance with an embodiment of the present invention as viewed from the vehicle compartment.
Figure 2:
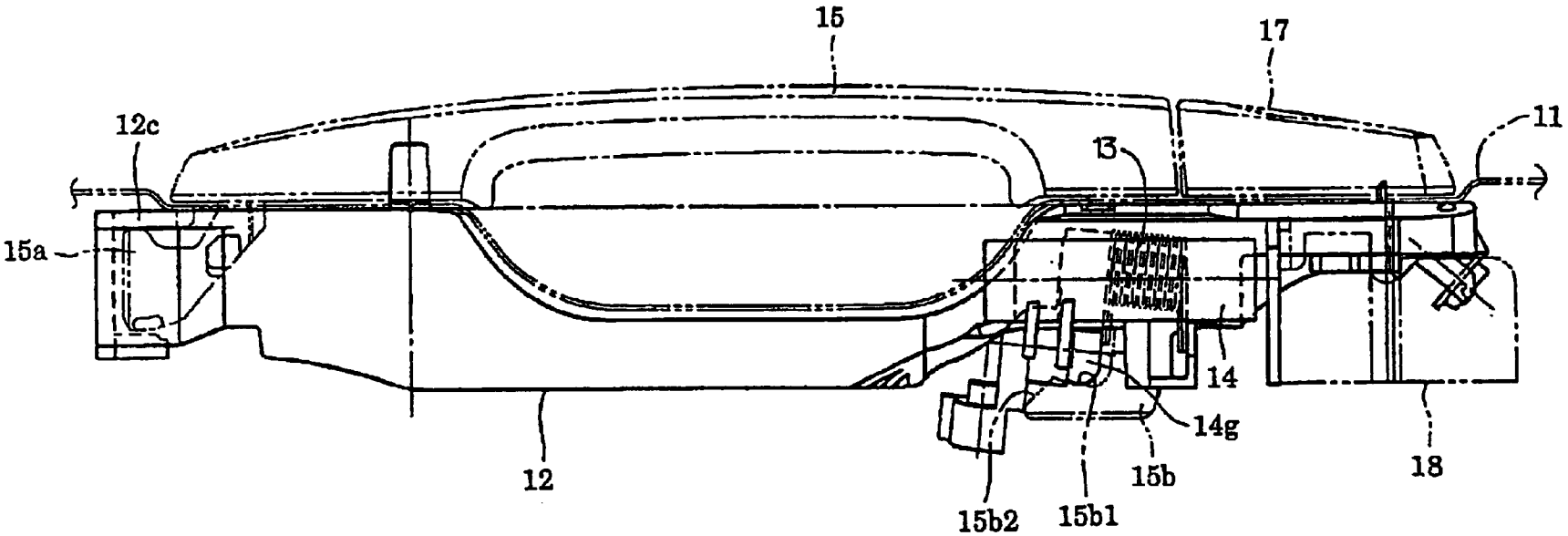
FIG. 2 is a plan view of the vehicle door handle device shown in FIG. 1.
Figure 3:
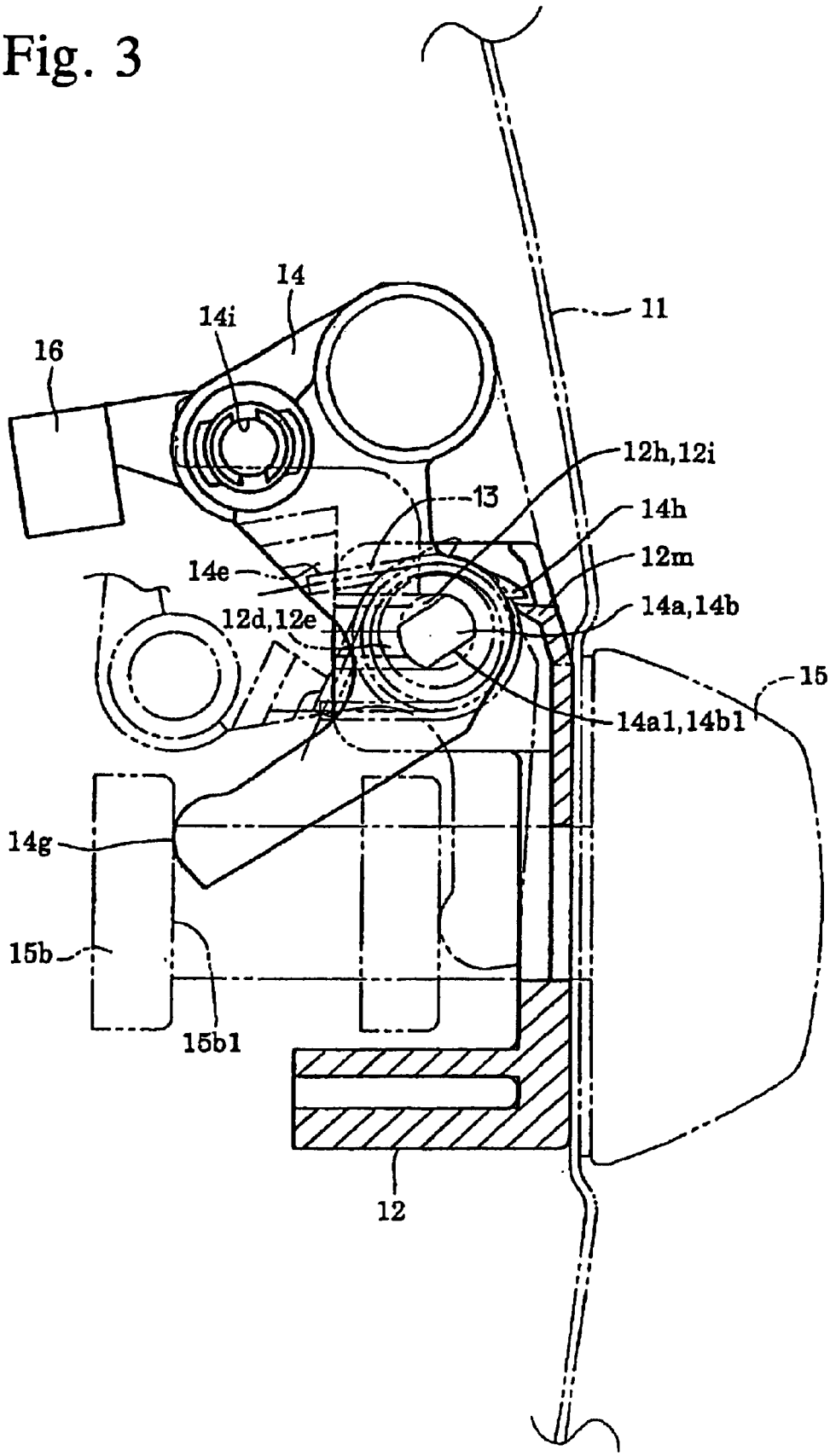
FIG. 3 is a cross-sectional view of the door handle device taken along the section line III—III in FIG. 1.

Referring to FIGS. 1–3, the door handle device for a vehicle A in accordance with the present invention includes a frame 12 secured to the inside of the outer panel 11 of the vehicle door, a link 14 rotatably mounted to the frame 12 and urged by a spring 13 to rotate in one direction, and a grip-type outer handle 15 mounted from outside the outer panel 11. The outer handle 15 includes an engaging portion 15*a* formed on one end of the outer handle 15 and an insertion projection 15*b* formed on the other end of the outer handle 15.

The frame 12 includes a first insertion hole 12*a* in which is inserted the engaging portion 15*a* of the outer handle 15 and a second insertion hole 12*b* in which is inserted the insertion projection 15*b* of the outer handle 15. Further, the frame 12 is provided with a supporting portion 12*c* located adjacent to the insertion hole 12*a*. The supporting portion 12*c* supports the engaging portion 15*a* of the outer handle 15 to permit the outer handle 15 to swing. The outer panel 11 is also provided with insertion holes corresponding to the insertion holes 12*a*, 12*b* in the frame 12.

Figure 4:
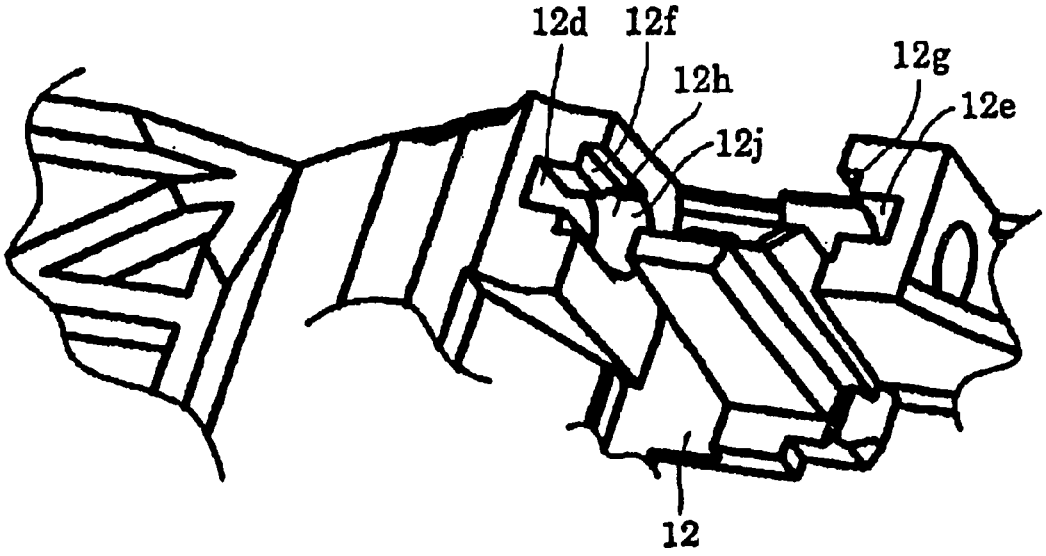
FIG. 4 is a perspective view of a portion of a frame on which a link of the vehicle door handle device is mounted.
Figure 5:
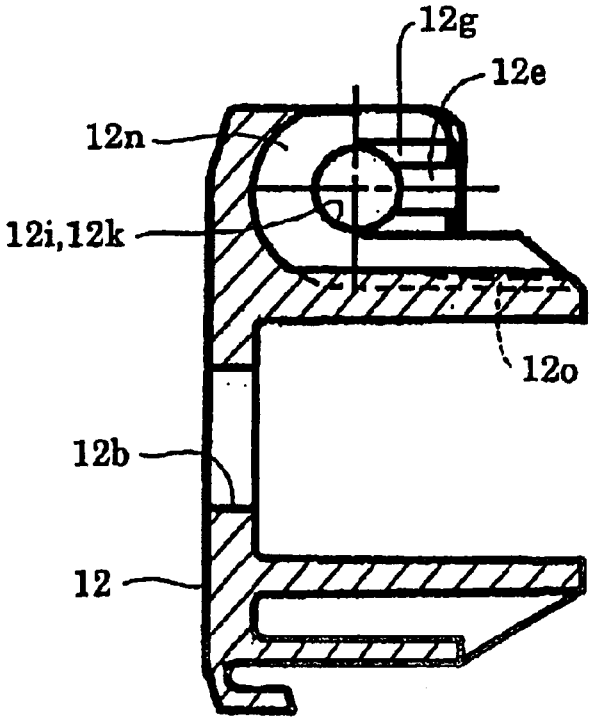
FIG. 5 is an enlarged cross-sectional view of the frame forming a part of the vehicle door handle device.

As shown in FIG. 1, FIG. 4 and FIG. 5, the frame 12 is provided with a pair of slots 12*d*, 12*e* having a narrower width and a pair of slots 12*f*, 12*g* having a wider width to mount or assemble the link 14 together with the spring 13. The frame 12 includes supporting holes 12*h*, 12*i*, 12*j*, 12*k* which are continuously formed on outer closed ends of the slots and which are coaxially arranged. Further, the frame 12 includes a second engaging nail portion (second engaging portion) 12*m*, a spring receiving portion 12*n* and a supporting groove 12*o* for supporting the right end 13*b* of the spring 13.

Figure 6:
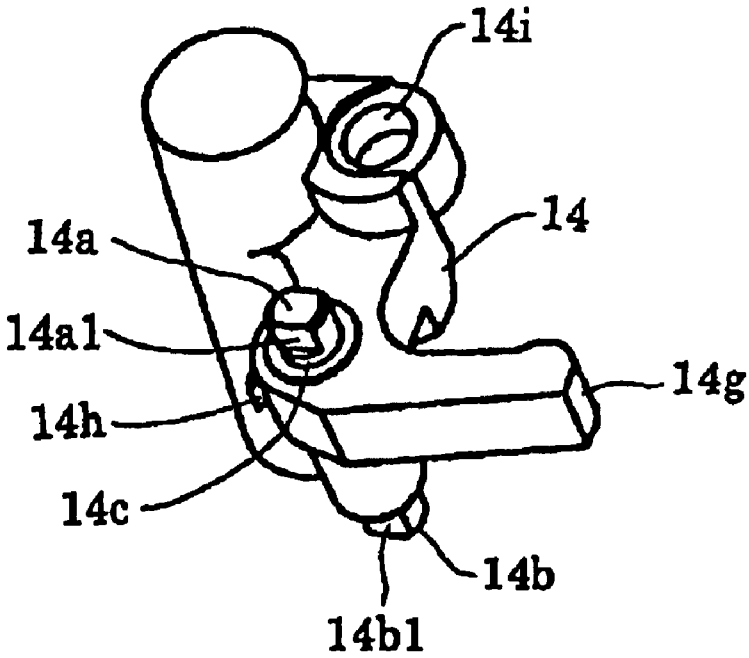
FIG. 6 is a perspective view of the link forming a part of the vehicle door handle device as seen from one side.
Figure 7:
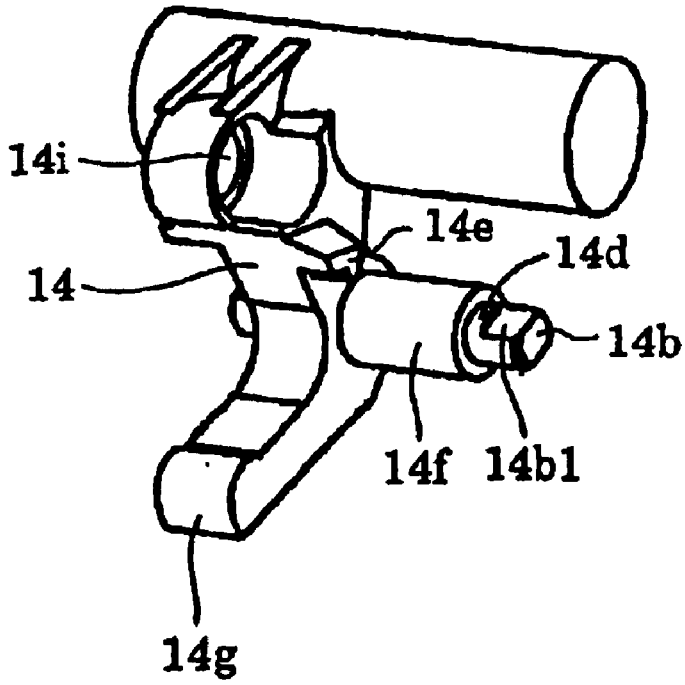
FIG. 7 is a perspective view of the link forming a part of the vehicle door handle device as seen from the other side.

The link 14 includes first axially extending axle portions 14*a*, 14*b* each having two faced portions (i.e., portions that are two-faced or have two flat surfaces) 14*a*1, 14*b*1 as shown in FIGS. 6 and 7. The slots 12*d*, 12*e* in the frame 12 receive the first axle portions 14*a*, 14*b* of the link 14. The first axle portions 14*a*, 14*b* of the link 14 are adapted to be inserted into the slots 12*d*, 12*e* from inside when the two faced portions 14*a*1, 14*b*1 are aligned with the slots 12*d*, 12*e*.

The link 14 also includes second axially extending axle portions 14*c*, 14*d*. The second axle portions 14*c*, 14*d* of the link 14 are adapted to be inserted into the slots 12*f*, 12*g* of the frame 12, with the second axle portions 14*c*, 14*d* being inserted from inside. Upon insertion, the supporting holes 12*h*, 12*i* rotatably support the first axle portions 14*a*, 14*b* of the link 14 and the supporting holes 12*j*, 12*k* support the second axle portions 14*c*, 14*d*.

Figure 8A:
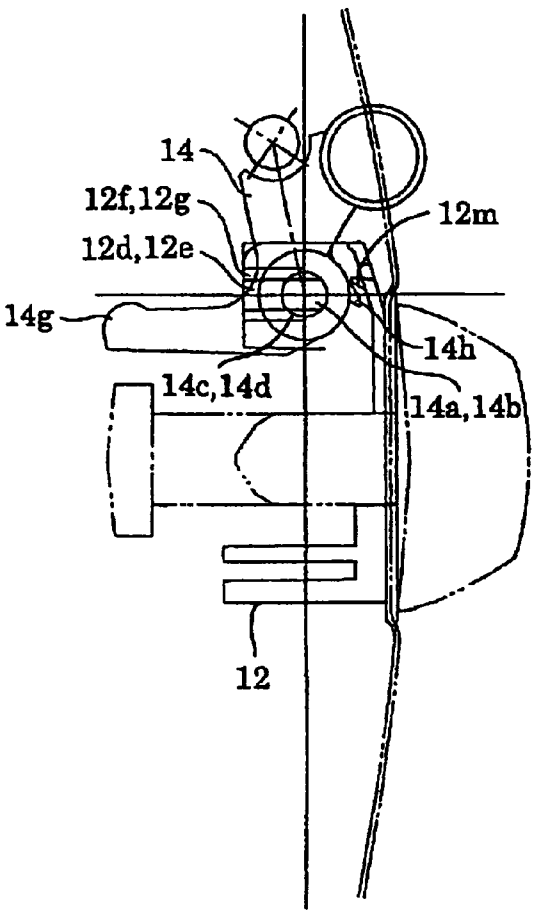
FIGS. 8(*a*), 8(*b*) and 8(*c*) illustrate the assembly process associated with the link and the outer handle.
Figure 8B:
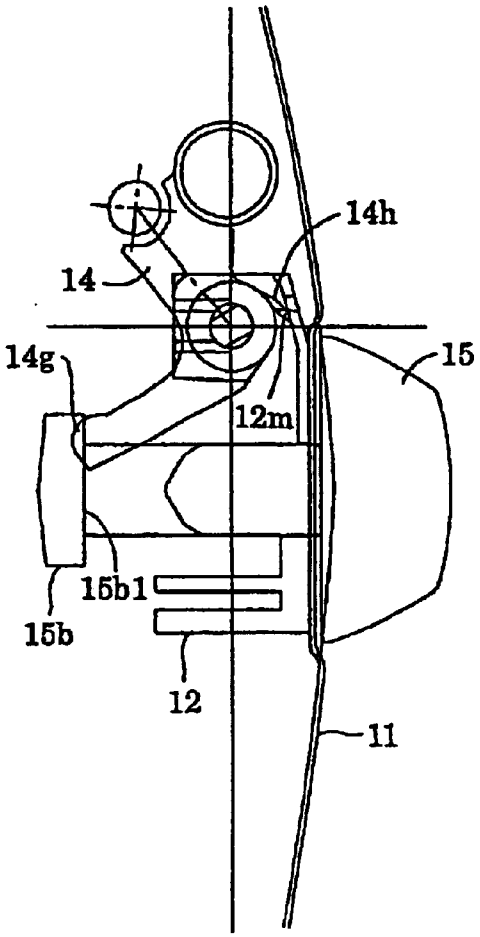
Figure 8C:
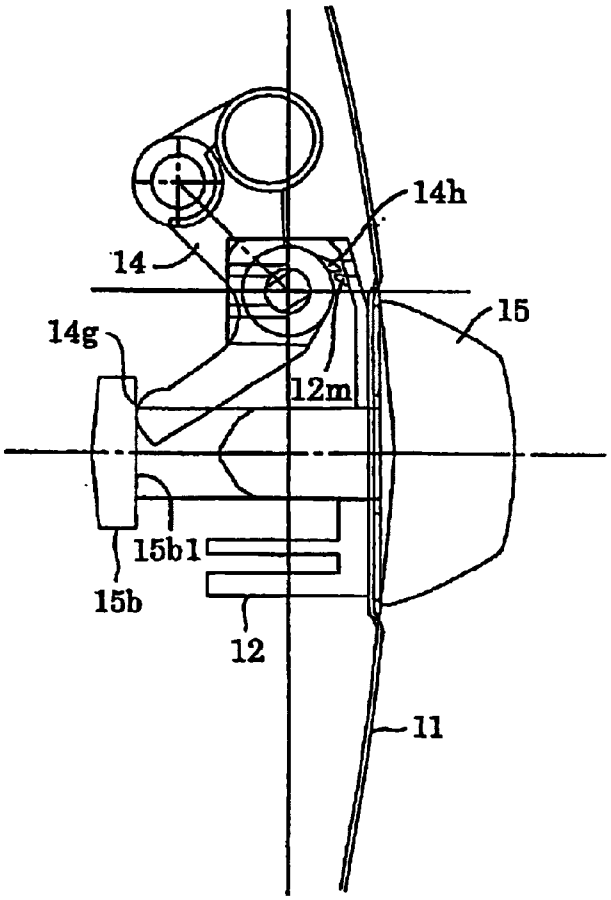

The link 14 includes a first engaging nail portion (first engaging portion) 14*h*. The second engaging nail portion 12*m* of the frame 12 is adapted to be elastically deformed by the first engaging nail portion 14*h* when the link 14 is rotated from the initial inserted position shown in FIG. 8(*a*) by a predetermined amount against the urging force of the spring 13 as shown in FIG. 8(*b*). After such rotation, the second engaging nail portion 12*m* engages the first engaging nail portion 14*h* so that the link 14 is held in its preliminary holding position which is shown in FIG. 8(*b*). In the inserted initial position shown in FIG. 8(*a*), each of the axle portions 14*a*–14*d* of the link 14 is completely inserted into the respective supporting hole 12*h*–12*k* and is able to rotate in the respective supporting hole 12*h*–12*k*.

The spring 13 is a torsion spring which urges the link 14 to rotate in the clockwise direction in FIG. 3. In the condition in which the spring 13 is interposed at the predetermined position between the frame 12 and the link 14 (i.e., the condition shown in FIGS. 1 and 2), one end 13*a* of the spring 13 engages an engaging surface 14*e* of the link 14, the other end 13*b* of the spring 13 engages the engaging groove 12*o* of the frame 12, and a cylindrical portion 13*a* of the spring 13 is fitted on an axle portion 14*f* of the link 14 with a predetermined gap. The axle portion 14*f* forms a spring mounting portion of the link.

As shown In FIGS. 3, 6 and 7, the link 14 includes the first axle portions 14*a*, 14*b*, the second axle portion 14*c*, 14*d*, the engaging surface 14*e* which engages one end 13*a* of the spring 13, and the axle portion 14*f* for holding the cylindrical portion 13*c* of the spring 13. The two faced portions 14*a*1, 14*b*1 of the link 14 are formed on the outer circumferential surfaces at the ends of the first axle portions 14*a*, 14*b*, respectively. Each of the two faced portions 14*a*1, 14*b*1 includes two faces which are generally planar or flat and parallel to one another.

The second axle portions 14*c*, 14*d* are formed coaxially with the first axle portions 14*a*, 14*b*, respectively. Each of the second axle portions 14*c*, 14*d* has a circular cross-sectional shape. Thus, the cross-sectional shape of the second axle portions 14*c*, 14*d* is different from the cross-sectional shape of the first axle portions 14*a*, 14*b*.

Further, the link 14 includes an input portion 14*g* which engages an engaging concave or recessed portion 15*b*1 formed on the insertion projection 15*b* of the outer handle 15. The link 14 also includes the first engaging nail portion 14*h* which projects outwardly in the diametrical direction with respect to the center of the axle portion 14*f* and an installing hole 14*i* for installing a clip 16. The link 14 is referred to as a bell-crank.

As shown in FIGS. 1–3, the outer handle 15 is provided at its one end with the engaging portion 15*a* which is engaged with the supporting portion 12*c* of the frame 12 so as to be able to swing. The outer handle 15 is provided at its other end with the insertion projection 15*b* having the engaging concave portion 15*b*1 and a taper portion 15*b* 2. As mentioned above, the engaging concave portion 15*b*1 engages the input portion 14*g* of the link 14.

Under the condition in which the outer handle 15 is assembled as shown in FIG. 2 by the two dotted line, the outer handle 15 can operate the link 14 so that the link 14 rotates against the urging force of the spring 13. When the link 14 is operated by the outer handle 15, a link rod (not shown) connected to the link 14 through the clip 16 is moved and the latched condition of the door latch device (not shown) is released.

The above described door handle device A is assembled in the following manner. Initially, the spring 13 is preliminary assembled with the link 14 by fitting the cylindrical portion 13*c* of the spring 13 on the axle portion 14*f* of the link 14 and engaging one end 13*a* of the spring 13 with the engaging surface 14*e* of the link 14. The link 14 is preliminarily positioned so that the two faced portions 14*a*1, 14*b*1 of the first axle portions 14*a*, 14*b* are aligned with the slots 12*d*, 12*e* of the frame 12 and the second axle portions 14*c*, 14*d* are aligned with the slots 12*f*, 12*g*. Then, the link 14 is moved from the inside of the frame 12 toward the outer closed ends of each of the slots so that the first axle portions 14*a*, 14*b* are inserted into or received in the supporting holes 12*h*, 12*i* and the second axle portions 14*c*, 14*d* are inserted into or received in the supporting holes 12*j*, 12*k*. The spring 13 is thus assembled to the predetermined position between the frame 12 end the link 14 as shown in FIG. 8(*a*).

Then, after the first axle portions 14*a*, 14*b* and the second axle portions 14*c*, 14*d* are completely inserted into the respective supporting holes 12*h*, 12*i* and the respective supporting holes 12*j*, 12*k*, (i.e., after the first axle portions 14*a*, 14*b* and the second axle portions 14*c*, 14*d* are located at the inserted initial position), the link 14 is rotated the predetermined amount or slightly more than the predetermined amount against the urging force of the spring 13. The predetermined amount is the amount of rotation required to move the engaging portion 14*h* of the link past the engaging portion 12*m* of the frame 12. With this rotation, the first engaging nail portion 14*h* of the link 14 elastically deforms the second engaging nail portion 12*m* of the frame 12 and moves over or past the second engaging nail portion 12*m*.

As a result, when the link 14 is thereafter rotated by the urging force of the spring 13, the first engaging nail portion 14*h* engages the second engaging nail portion 12*m* and the link 14 is held in its preliminary holding position shown in FIG. 8(*b*). In this preliminary holding position, each of the two faced portions 14*a* 1, 14*b* 1 of the link 14 is rotated by the predetermined amount with respect to the slots 12*d*, 12*e* and thus no longer coincide with or are aligned with the slots 12*d*, 12*e*. Therefore, the two faced portions 14*a*1, 14*b*1 are not able to move out of the slots 12*d*, 12*e*.

Further, in the preliminary holding position, by using the movement (rotation) of the link 14 against the spring 13, the outer handle 15 can be mounted or assembled from the outside of the outer panel 11 by one movement assembly. That is, the outer handle 15 is mounted or assembled as follows.

Initially, the engaging portion 15*a* located at one end of the handle 15 is inserted through an insertion hole of the outer panel 11 and the insertion hole 12*a* of the frame 12 while the insertion projection 15*b* located at the other end of the handle 15 is inserted through another insertion hole of the outer panel 11 and the insertion hole 12*b* of the frame 12. In this condition, the outer handle 15 is moved along the panel towards the left in FIG. 2. The link 14 is temporally rotated by the taper portion 15*b*2 of the insertion projection 15*b* against the urging force of the spring 13.

Consequently, the outer handle 15 is assembled in the manner shown in FIG. 2 and FIG. 8(*c*). In this assembled condition, the engaging portion 15*a* is supported on the supporting portion 12*a* of the frame 12 so as to be able to swing. On the other hand, the input portion 14*g* is elastically engaged with the engaging concave or recessed portion 15*b*1 of the outer handle 15 and the first engaging nail portion 14*h* of the link 14 is slightly separated from the second engaging nail portion 12*m* (refer to FIG. 8(*c*)). After the outer handle 15 is assembled to the frame 12, a cap 17 is fixed to the frame 12 as shown in FIG. 2 and the outer handle 15 is prevented from moving along the outer panel 11. FIG. 2 illustrates a protector 18 that is provided for preventing robbery. A pad may be disposed between the outer panel 11 and the outer handle 15 or the cap 17.

As described above, the door handle device A according to the illustrated and described embodiment of the present invention requires only the spring 13 for holding the link 14 in the preliminary holding position shown in FIG. 8(*b*) because the other structures are formed on the link 14 and the frame 12 in one body or as a unitary structure. Therefore, the number of parts for assembling the link 14 with the frame 12 can be reduced. Accordingly, improvements in the operation efficiency for assembling or mounting the link 14 on the frame 12 can be realized and the manufacturing costs associated with the door handle device can be decreased.

In addition, the second axle portions 14*c*, 14*d* which are formed coaxially with the first axle portions 14*a*, 14*b* are integrally formed on the link 14 as one unitary structure, and the slots 12*f*, 12*g* and the supporting holes 12*j*, 12*k* are integrally formed on the frame 12 as one unitary structure. Thus, the link 14 is supported at the first axle portions 14*a*, 14*b* on the supporting holes 12*h*, 12*i* and at the second axle portions 14*c*, 14*d* on the supporting holes 12*j*, 12*k* so as to be able to rotate. Compared to a construction in which the link 14 is supported at only one set of axle portions having two faced portions so as to be able to rotate, it is possible to decrease the gap between the frame 12 and the link 14 when the link 14 is assembled with the frame 12, and the link 14 can be reliably supported on the frame 12.

The principles, preferred embodiment and modes of assembly and operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door handle device comprising:

a frame secured to an inside of an outer panel of a vehicle door and having a supporting portion and insertion holes;

a link rotatably mounted to the frame and urged by an urging force of an elastic member in one rotational direction;

a grip-type outer handle mounted from outside the outer panel and operatively associated with the link to operate the link so as to rotate against the urging force of the elastic member;

the link being provided with a first engaging portion and axle portions each having a two faced portion;

the frame being provided with slots for inserting each of the two faced portions;

the frame being provided with supporting holes for rotatably supporting the axle portions; and the frame being provided with a second engaging portion which engages the first engaging portion for holding the link in a preliminary holding position.

2. The vehicle door handle device as set forth in claim 1, wherein the axle portions and the first engaging portion are integrally formed on the link so that the link, the axle portions and the first engaging portion are unitarily formed as one piece.

3. The vehicle door handle device as set forth in claim 2, wherein the first engaging portion deforms the second engaging portion when the link is rotated a predetermined amount against the urging force of the elastic member.

4. The vehicle door handle device as set forth in claim 3, wherein the axle portions are first axle portions, the link including second axle portions each coaxially arranged with one of the first axle portions, the second axle portions having a circular cross-sectional shape, the second axle portions being integrally formed with the link so that the link and the second axle portions are unitarily formed as one piece, the frame including second slots for inserting the second axle portions and second supporting holes for rotatably supporting the second axle portions.

5. The vehicle door handle device as set forth in claim 1, wherein the outer handle is provided at its one end with an engaging portion inserted through one of the insertion hole and engaged with the supporting portion so as to be able to swing, an opposite end of the frame being provided with an insertion projection inserted through an insertion hole different from the one insertion hole, the insertion projection having an engaging recessed portion engaged with an input portion of the link.

6. The vehicle door handle device as set forth in claim 1, wherein the first engaging portion deforms the second engaging portion when the link is rotated a predetermined amount against the urging force of the elastic member.

7. The vehicle door handle device as set forth in claim 1, wherein the axle portions are first axle portions, the link including second axle portions each coaxially arranged with one of the first axle portions, the second axle portions having a circular cross-sectional shape, the second axle portions being integrally formed with the link so that the link and the second axle portions are unitarily formed as one piece, the frame including second slots for inserting the second axle portions and second supporting holes for rotatably supporting the second axle portions.

8. The vehicle door handle device as set forth in claim 1, wherein the link includes a mounting portion, the elastic member being mounted on the mounting portion.

9. A vehicle door handle device comprising:

a frame secured to an inside of an outer panel of a vehicle door, the frame having insertion holes, the frame including a pair of slots, a pair of supporting holes, and an engaging portion;

a link rotatably mounted on the frame and having an engaging portion, the link including a pair of axle portions each having at least one flat surface, each axle portion being insertable into one of the slots in the frame and rotatably supported by one of the supporting holes;

a spring connected to the link and applying a rotational urging force to the link in one rotational direction;

an outer handle having an insertion portion passing through the outer panel and into one of the insertion holes, the outer handle having an engaging portion passing through the outer panel and into another of the insertion holes, the insertion portion of the outer handle being in engagement with a portion of the link to rotate the link against the urging force of the elastic member upon operation of the outer handle;

the engaging portion of the frame engaging the engaging portion of the link to hold the link in a preliminary holding position.

10. The vehicle door handle device as set forth in claim 9, wherein the axle portions and the engaging portion of the link are integrally formed on the link so that the link, the axle portions and the engaging portion of the link are unitarily formed as one piece.

11. The vehicle door handle device as set forth in claim 9, wherein the engaging portion of the link deforms the engaging portion of the frame when the link is rotated a predetermined amount against the urging force of the elastic member.

12. The vehicle door handle device as set forth in claim 9, wherein the axle portions are first axle portions, the slots are first slots and the supporting holes are first supporting holes, the link including second axle portions each coaxially arranged with one of the first axle portions, the second axle portions having a circular cross-sectional shape, the second axle portions being integrally formed with the link so that the link and the second axle portions are unitarily formed as one piece, the frame including second slots for inserting the second axle portions and second supporting holes for rotatably supporting the second axle portions.

13. The vehicle door handle device as set forth in claim 9, wherein the engagement of the insertion portion of the outer handle with a portion of the link includes the insertion projection having an engaging recessed portion engaged with an input portion of the link.

14. The vehicle door handle device as set forth in claim 9, wherein the link includes a mounting portion on which is mounted the spring.

15. A vehicle door handle device comprising:

a frame secured to an inside of an outer panel of a vehicle door, the frame having a first pair of supporting holes and a second pair of supporting holes;

a link rotatably mounted on the frame by way of a pair of first axle portions and a pair of second axle portions, the first axle portions and the second axle portions having different cross-sectional shapes, each of the first axle portions being rotatably supported in one of the first supporting holes and each of the second axle portions being rotatably supported in one of the second supporting holes;

a spring connected to the link and applying a rotational urging force to the link in one rotational direction;

an outer handle mounted from outside the outer panel of the vehicle, a portion of the outer handle engaging a portion of the link to rotate the link against the urging force of the elastic member upon operation of the outer handle; and a part of the frame engaging a part of the link to hold the link in a preliminary holding position.

16. The vehicle door handle device as set forth in claim 15, wherein the link includes a mounting portion on which is mounted the spring.

17. The vehicle door handle device as set forth in claim 15, wherein each of the second axle portions is coaxial with one of the first axle portions.

18. The vehicle door handle device as set forth in claim 15, wherein the outer handle is provided at its one end with an engaging portion inserted into a first insertion hole in the frame and is provided at its opposite end with an insertion projection inserted through a second insertion hole in the frame, the insertion projection having an engaging recessed portion engaged with an input portion of the link.

19. The vehicle door handle device as set forth in claim 1, wherein the link has an input portion and the grip-type outer handle has an insertion projection engageable with the input portion of the link, the link being held in the preliminary holding position by the engagement between the second engaging portion and the first engaging portion so that the insertion projection of the grip-type outer handle can engage the input portion of the link.

20. The vehicle door handle device as set forth in claim 15, wherein the link is held in the preliminary holding position by engagement of the part of the frame with the part of the link so that the portion of the outer handle can engage the portion of the link.

* * * * *